United States Patent [19]

Moser et al.

[11] Patent Number: 4,872,325

[45] Date of Patent: Oct. 10, 1989

[54] METHOD AND DEVICE FOR IMPRINTING WEBS

[75] Inventors: Manfred Moser, Krefeld-Fischeln; Dieter Itgenshorst, Krefeld; Johannes Kutz, Tönisvorst, all of Fed. Rep. of Germany

[73] Assignee: Eduard Küsters Maschinenfabrik GmbH & Co KG, Krefeld, Fed. Rep. of Germany

[21] Appl. No.: 64,214

[22] Filed: Jun. 19, 1987

[30] Foreign Application Priority Data

Jun. 21, 1986 [DE] Fed. Rep. of Germany ..... 3620864

[51] Int. Cl.[4] ..... D06B 1/08

[52] U.S. Cl. ..... 68/200; 100/211; 101/119; 118/410

[58] Field of Search ..... 68/200, 21, 43, 44, 68/45, 96, 242; 100/211; 101/119, 120; 118/410, 411, 412, 415

[56] References Cited

U.S. PATENT DOCUMENTS 3,934,502 1/1976 Marino ..... 101/119 X
4,455,845 6/1984 Schiffer .
4,576,112 3/1986 Funger et al. .

FOREIGN PATENT DOCUMENTS 2828961 1/1980 Fed. Rep. of Germany .
1381081 10/1964 France .

*Primary Examiner*—Philip R. Coe
*Attorney, Agent, or Firm*—Kenyon & Kenyon

[57] ABSTRACT

A liquid, foam or paste treatment medium is applied to a textile or similar web as the web is led through a gap in which the web is pressed resiliently against an opposing face in an area extending over the width of the web with non-uniform pressure by, for example, several adjacent cushions that are independently inflatable. The non-uniform pressure serves primarily to achieve uniform treatment, in particular, uniform coloring, despite the non-uniform conditions existing over the web width. The non-uniform pressure may also be used for imprinting patterns on the web.

6 Claims, 4 Drawing Sheets

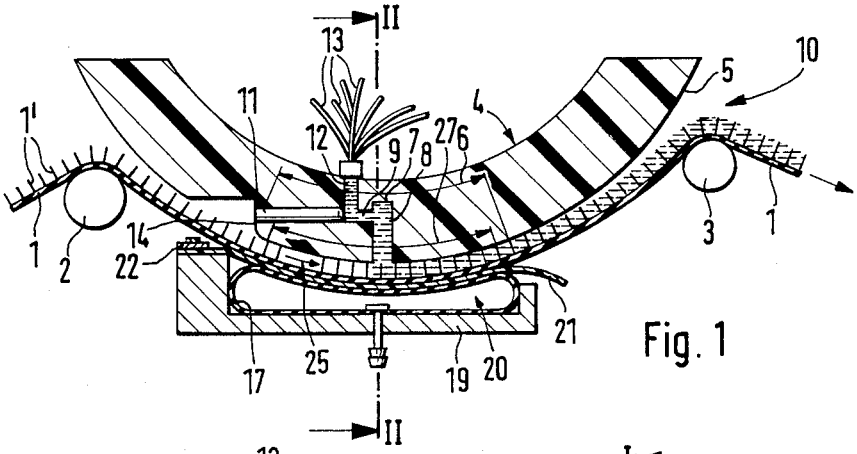
Fig. 1
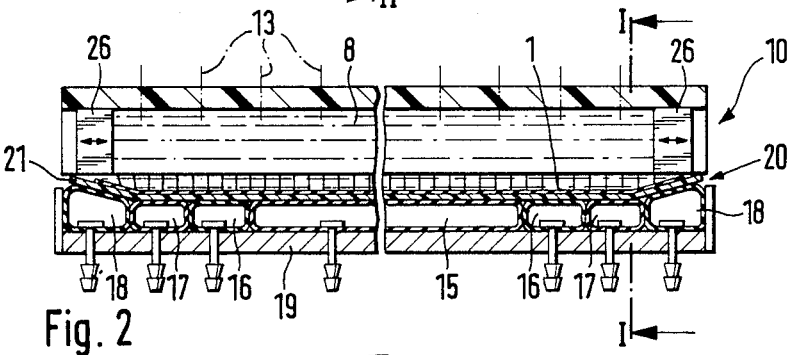
Fig. 2
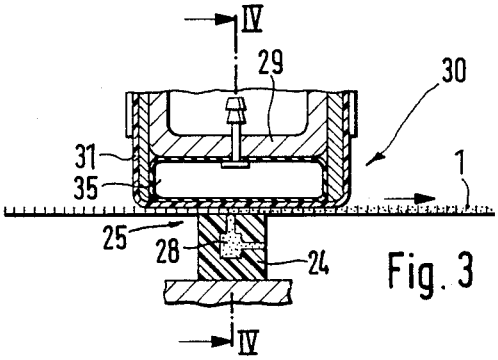
Fig. 3
Fig. 4
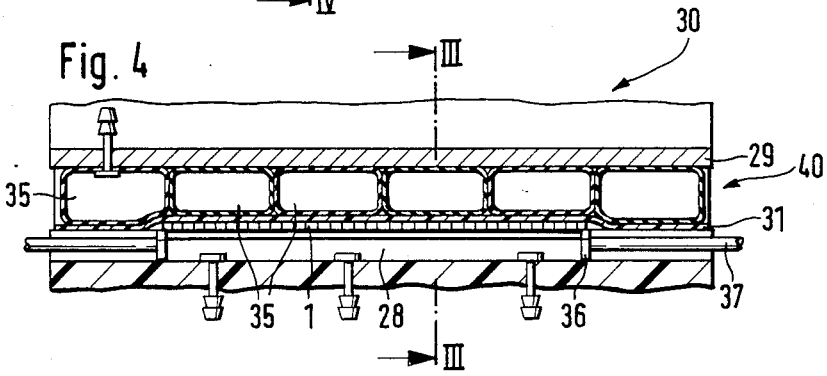

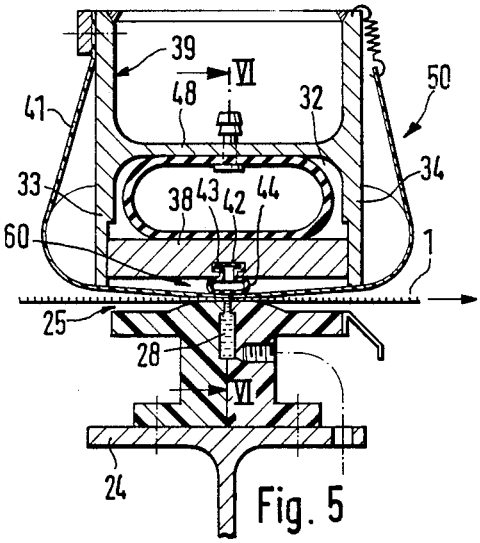
Fig. 5
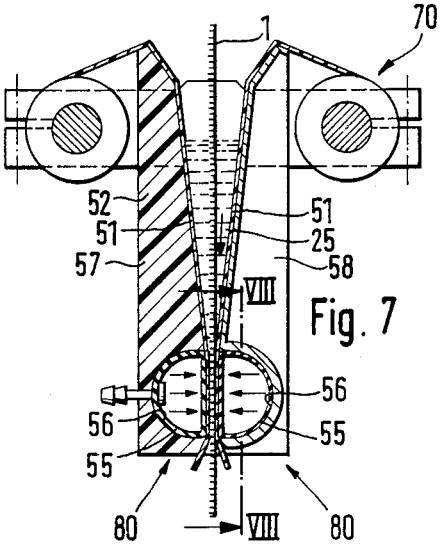
Fig. 7
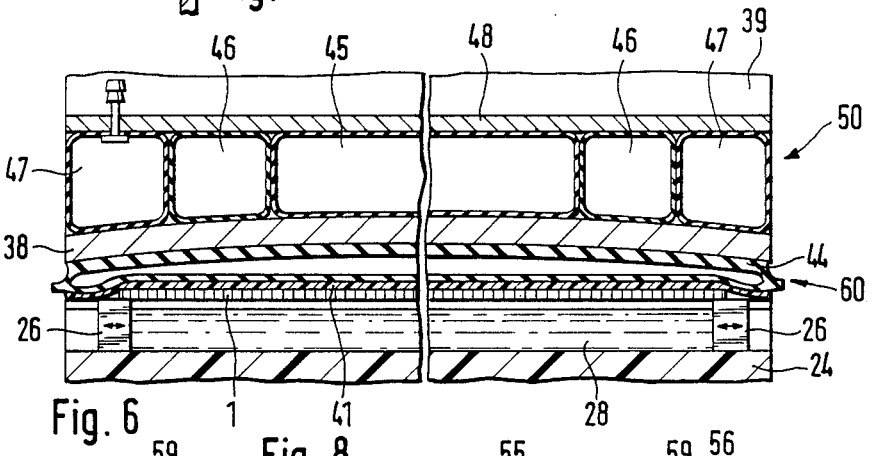
Fig. 6
Fig. 8
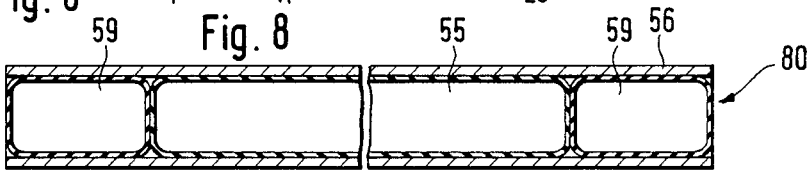
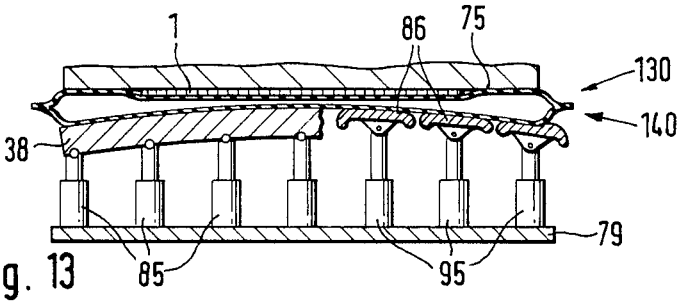
Fig. 13

METHOD AND DEVICE FOR IMPRINTING WEBS

BACKGROUND OF THE INVENTION

The invention generally relates to a method and apparatus for applying a treatment medium to a textile web in which the web is resiliently pressed against a stationary surface as the web is passed through a gap.

A method of this nature and a device of this kind are disclosed in DE-OS 33 15 770. In this patent the gap is closed on one side by a protruding application bar that forms an opposing face in which a slot is arranged that extends over the web and from which the treatment medium can be squeezed out. Opposite the slot an oblong cushion is arranged, which extends transversely over the width of the web. The cushion rests against a fixed support on the side facing away from the slot. The cushion is covered by a glide foil, which is fastened on the edge opposing the machine direction. The web is pulled through between the opposing face and the glide foil, with the treatment medium, which flows from the slot into the web, being pressed into the web. Since the cushion extends over the entire width of the Web, and since the pressure in the cushion propagates uniformly, the pressure exerted on the web is uniform over the entire width.

A further device is disclosed in FRP 13 81 081. This patent teaches the formation of a vertical narrow treatment trough, which is filled to a certain height with the treatment medium, and through which the web is led in a downward direction. At the lower end of the treatment trough the sides of the treatment trough parallel to the web adjoin the web on s both sides and are pressed against each other by opposing pressure tubes which act from the outside against the lower portions of the sides. In this patent the opposing face is thus also resiliently elastic, and feed of the treatment medium does not take place at the opposing face, but rather at the height of the fill level in the trough through which the web passes. In the first embodiment the web is pulled between the opposing face and the glide foil and in the second embodiment between the sides of the trough that are pressed against each other. It must, therefore, have a certain tensile strength. In addition, and integral to the function of the known devices, the treatment medium is to some extent pressed or massaged into the web. Thus, web must be able, to some extent, to absorb the treatment medium. Textile webs such as woven fabrics and especially those fabrics With pile are primarily of interest. Fabrics with thicker fleece having sufficient tensile strength can, however, also be processed according to this method. No restrictions regarding the web type exist otherwise.

The apparatus disclosed in DE-OS 33 15 770 has proven useful not only in the dyeing of carpeting, but also in the dyeing of flat woven materials. On some occasions, however, it has been observed that the application of the treatment medium is very sensitive to the pressure exerted on the web when it passes the slot. If the pressure rises in a particular site, the web in this location receives noticeably less treatment medium. This effect can be observed especially when materials with pile are used because the volume of the pile is reduced by compression and volume, which could absorb the liquid is eliminated in the process because the material is compressed, is no longer as absorbent as before. The two effects, thus, overlap and relatively slight pressure differences result, for example, in readily noticeable differences in shade and saturation of color when liquid treatment media are used. This leads to problems in the uniformity of dyeing especially at the edges of the web where uniformity of pressure sometimes cannot completely be ensured and where, furthermore, the web for reasons of structure and selvedge absorbs the liquid dye differently than in the web middle even if the pressure is uniform.

The invention, therefore, is directed to the problem of, on the one hand, ensuring treatment which is uniform over the web even if absorption of the treatment medium by the web varies, and on the other hand, advantageously utilizing the recognized sensitivity of the method to differences in pressure for the purposed of imprinting patterns on the web.

SUMMARY OF THE INVENTION

The invention solves this problem by providing a method and apparatus in which the web is pressed against the opposing face with a non-uniform pressure. The resilient pressure exerted in the slot on the web is thus no longer necessarily uniform over the entire width of the web, but can intentionally be non-uniform. This is done for the purpose of ensuring on the web, which may absorb the treatment medium unevenly, nevertheless uniform application of the pressure fluid over the width of the web and, thus, achievement of uniformity of treatment through appropriately adjusted pressure control. This is a significant aspect of the invention.

On the other hand, by varying the pressure control different imprinting results can be achieved over the surface of the web of the fabric. For example, dyeing can appear graded or veiled, as it is intended for some materials influenced by fashion and also for carpeting. The specific pressure, the non-uniformity of which varies depending on the pattern, can vary spatially, that is in the direction transverse to the web, and also temporally on passing the slot such that, broadwise in one and the same location in different regions along the web, differences in the shade and saturation of color can exist.

The apparatus of the invention employs various means for pressing the web non-uniformly that may comprise resilient pressing elements. Where the best possible uniformity of treatment over the width of the web is a concern, provision of a first pressure in the center of the web and a second pressure at the web edges has in many instances been found to be sufficient. Both edge regions may be acted upon independent of the center region which is treated uniformly.

The means for pressing the web with a non-uniform pressure may comprise an oblong cushion extending over the width of the web. By "cushion" what is meant is a hollow body with flexible walls which is filled with a fluid medium to an internal pressure that is uniform over its entire length. The cushion transmits this internal pressure essentially uniformly to the web when placed against it.

A configuration of this general nature is disclosed in DE-OS 33 15 770 in which the cushion extends over the entire width of the web. According to the invention, the cushion is subdivided into several sections forming individual cushions adjacent to each other, which can be filled with fluid medium independent of each other such that in each individual section an essentially uniform pressure can be exerted. However, adjacent sections may be adjusted to exert differing pressures. To be a "cushion" in this sense, the internal pressure must be propagated uniformly over the entire extent of each section.

However, other types of resilient pressure elements are disclosed per se in FRP 13 81 081, in particular, resilient elements which can be compressed and have some degree of inherent stability, such as thick-walled tubing, cylindrical or rod-shaped elastomer sections or similar elements. When such elements are compressed in one location, other locations s sufficiently transversely spaced to the web remain substantially unaffected.

A "cushion" can have non-rigid walls and fulfill its function in the presence of internal pressure. Without this internal pressure it Would collapse upon itself and could not function as a resilient pressure element. The pressing elements according to FRP 1381081 do not collapse even in the absence of internal pressure because of their inherent stability. It is, however, also possible, to use pressing elements which combine both properties, for example, relatively stable tubing having internal pressure. Filling the tubing with fluid medium yields a pressure component Which is uniform over the width of the web and, in addition, because of its inherent rigidity is able upon compression to exert varying forces at different locations transverse to the web.

The means for pressing may not be subdivided into separately actuatable sections, but rather may be a continuous member acted upon by separately actuatable additional pressing elements, from which originate the varying pressures exerted on the web. The pressing means may act directly upon the continuous member. However, in some cases this may cause problems at the transitions of the effective regions of the distinct pressure elements because of the occurrence of pressure stages in these locations. For this reason a bar or plate may be provided for bridging the above-mentioned pressure stages such that no change of pressure can occur at short transition distances transverse to the web. Over larger transition distances, however, the bar or the plate should still be resilient such that it can compress the pressing element in different regions transverse to the web and thereby generate different pressure effects in the web. Other advantageous embodiments are disclosed herein.

The drawing schematically represents several embodiments of the invention discussed below.

BRIEF DESCRIPTION OF THE DRAWINGS

FIG. 1 shows a cross section along line I—I of FIG. 2 in a longitudinal plane perpendicular to the web of a carpet dyeing facility constructed according to the invention.

FIG. 2 is a cross sectional view along line II—II in FIG. 1.

FIG. 3 shows a cross section according to FIG. 1 of a modified embodiment along line III—III in FIG. 4.

FIG. 4 is a cross sectional view along line IV—IV in FIG. 3.

FIG. 5 shows a cross sectional view according to FIG. 1 of a third embodiment.

FIG. 6 represents a partial section along line VI—VI in FIG. 5.

FIG. 7 is a view corresponding to FIG. 1 of a fourth embodiment.

FIG. 8 shows a partial section along line VIII—VIII in FIG. 7.

FIG. 13 shows schematically a cross section in a transverse plane perpendicular to the web of two further embodiments of the invention

DETAILED DESCRIPTION

Figure 9:
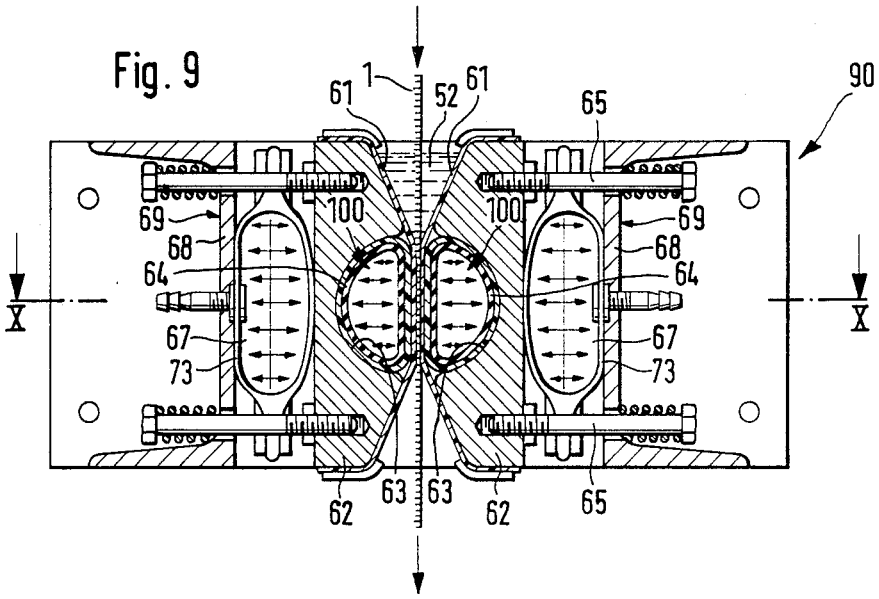
FIG. 9 represents a section corresponding to FIG. 1 of a fifth embodiment along line IX—IX in FIG. 10.
Figure 10:
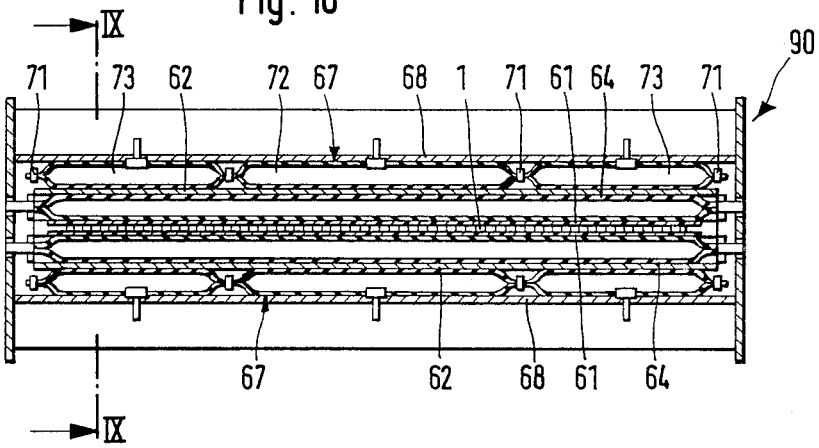
FIG. 10 is a sectional view along line X—X in FIG. 9 in reduced scale.

In the device labeled 10 in FIGS. 1 and 2, the web 1 is a carpet web, which, in a manner clearly apparent in the drawing, is led with the pile 1' facing upward over guide rollers 2, 3 which are parallel to each other and placed at approximately equal levels.

Between the guide rollers 2, 3 an application bar 4 is located in contact with the web 1 that is disposed transverse and parallel to the Web. Bar 4 forms on the side facing the web 1 an opposing face 5 acting as a glide surface. Application bar 4 may be formed from a longitudinal segment of thick-walled tubing of synthetic material. Opposing face 5 has a circular cylindrical convex shape.

The web 1 rests against the opposing face 5 in the encircling region indicated by the arrow 6. Approximately in the center of the wrapping region 6 a slot 8 forming an interior chamber is provided in the application bar 4. The slot extends approximately perpendicular to the opposing face 5 and terminates in the latter. Slot 8 extends continuously over the length of the application bar 4, i.e., the width of the web 1.

Close to the base of the slot 8 are ports of feed channels 9 disposed perpendicular to slot 8. A number of channels 9, for example twenty or fifty, are distributed over the length of the slot. The feed channels 9 are formed by transverse bores, which extend from an offset 14 in the opposing face 5 and are sealed to the outside with plugs 11. Each individual feed channel 9 is connected to a connecting channel 12, which leads approximately radially to the concave inside face of the application bar 4 and there connects to one of the feed ducts 13, which are evenly supplied with liquid treatment medium, for example, liquid dye, by a distributor.

During operation of the device 10, the treatment medium is supplied via the feed ducts 13, the connecting channels 12 and the feed channels 9 to the slot at sites distributed over its entire length. Supply takes place at right angles to the slot 8 such that the treatment medium, before flowing out of the slot 8 into the web 1, can be diverted and thereby made more uniform. The flow width can be adjusted to the width of the web 1 by sliding the element 26 which fills the cross section of slot 8 and seals it to the outside.

On the side of the web 1 opposing the slot 8, a resilient pressing element 20 is provided. The resilient pressing element 20 comprises an oblong cushion 15 provided in the center region of the web 1 that extends transverse to the web, as well as further cushions 16 17, 18 arranged next to each other, i.e., in the adjoining edge regions. Each cushion 15, 16, 17, 18 has, in a manner clearly evident in FIG. 2, its own connection and can accordingly be provided with its own individual internal pressure by having a fluid medium pumped into it, for example compressed air.

The resilient support element 20 is located on the side facing away from the web 1. Between the resilient pressing element 20 and the web 1 a fixed flexible glide foil 21 is arranged, which in the running direction of the web 1 shown in FIG. 1, i.e. parallel to the web, is fastened with its left edge at 22 on the support 19. The application bar 4 with the opposing face 5 on the one hand, as well as the resilient pressing element 20 and the glide foil 21, define a gap 25 through which the web 1 is pulled. The resilient pressing element 20 presses the glide foil 21 and the web 1 against the opposing face 5. The specific pressure to which the web 1 is subjected in the gap 25 can be selectively varied by variably inflating the cushions 15, 16, 17, 18.

In the device 30 shown in FIG. 3 and 4, the application bar 4 with the slot 28 forms the opposing face 5. Bar 24 comprises a stationary carrier extending over the width of the web 1. On the underside of support 29 that faces the web 1 a resilient pressing element 40 is provided in the form of several separately inflatable cushions of equal width arranged over the width of the web immediately adjacent to each other. Between the cushions 35 and the web 1 a glide foil 31 is provided, which is fastened at the sides of the carrier 29 in a manner evident in FIG. 3 such that the resilient unit comprising the cushion 35 and the glide foil 31 does not vibrate when the web 1 is pulled through the gap 25.

The resilient pressing elements 20, 40 in FIGS. 1 to 4 comprise distinct cushions, which, similar to balloons, can be inflated with a fluid medium and do not need to possess any utilizable inherent stability until filled. In the device 50 of FIGS. 5 and 6 and pressing element 60 is in the form of tubing 44 that extends over the width of the web. Tubing 44 has inherent stability, that is, even without being filled with a fluid medium, it has resistance to being compressed which increases with the degree of deformation in its transverse direction.

In the device 50 as in the device 30 an application bar 24 with a slot 28 extending over the width of the web 1 is provided. The slot 28 is closed at its ends by adjustable elements 26 and in this way enables adjustment of the application width to the width of the Web 1. Above the Web 1 a support 39 in the form of a carrier is provided, which extends transversely over the web. The carrier has a chamber 32 open at the bottom. The chamber 32 is defined in the longitudinal direction of the web by posts 33, 34 which extend perpendicular to the web 1 and between which a plate 38, extending continuously over the width of the web 1, is adjustably guided in the direction perpendicular to the web 1.

Plate 38 has, on the side facing the web 1, a continuous T-groove 42 into which fits a T-shaped longitudinal projection provided on the tubular hollow section 44 that forms the resilient pressing element 60.

The tubular hollow section 44 rests, in a manner evident in FIG. 5, against the inside of the glide foil 41 fastened to the sides of the carrier 39, and presses the glide foil 41 against the web 1 and the web 1 against the port edges of the slot 28.

The plate 38 is supported by pressure elements 45, 46, 47 formed as inflatable hollow bodies and arranged between a stationary carrier 48, which extends parallel to the web 1 and connects the posts 33, 34, and the upper side of the plate 38. The pressure elements 45, 46, 47 can be separately pressurized to cause the plate 38 to bend in the manner shown in FIG. 6 if the pressure in the pressure element 45 spanning the center region of the web 1 is somewhat less than the pressures in the separate pressure elements 46, 47 in the region closer to the edges. The rigidity of plate 38 is such that at the marginal areas between the pressure elements 45, 46, 47 no deformation stages occur. However, over a greater area the plate can bend in the indicated manner via differences in pressure in the pressure elements 45, 46, 47. Bending of the plate 38 is transmitted to the resilient pressing element 60 such that in areas where element 60 is compressed more strongly, particularly at the edges of plate 38, more pressure is transferred to the glide foil 41 and the web 1 than in the center.

In the embodiments of FIGS. 1 to 6 supply of the treatment medium takes place through the gap 8, 28 in the opposing face 5, which was formed by a rigid part. In the design 70 according to FIGS. 7 and 8, in contrast, supply of treatment medium does not occur in the gap 25 and the opposing face is also resilient. As is evident in FIG. 7, a narrow vertical trough 52 is formed by two glide foils 51, located opposite each other in the indicated manner, through which the web 1 is guided vertically from above and which is sealed at both edges of the web 1 in an appropriate manner. The glide foils 51 are inclined toward each other and are disposed on a respective side adjacent to the web 1 in the gap 25. In this area, resilient pressing elements 80 in the form of inflatable cushions 55, 59 act upon the outside of the glide foils 51. The cushions are arranged in channel-like recesses 56 of carriers 57, 58 extending transverse over the width of the web 1. On the left-hand side of FIG. 7 a carrier 57 is shown, which, for example, may be formed as a massive element of synthetic material or, as shown on the right-hand side of the web 1, carrier 58 may be constructed from sheet metal.

The web 1 on passing through the trough 52 takes liquid, which, in the gap 25 by means of the pressure of the resilient pressing element 80 transmitted by glide foils 51 to the web, is pressed into and worked into the fabric.

The resilient pressing element 80 of the device 70 is subdivided over the width of the web 1 into several inflatable elastic hollow bodies 55, 59. Outside the hollow body 55 disposed in the center only one additional hollow body 59 is provided at each edge, which covers only approximately 10% of the total width. Pressurizing the hollow body 59 to a different pressure than hollow body 55 suffices to compensate for uneven edges that sometimes are encountered during treatment of the web 1.

The device 90 in FIG. 9 combines the features of device 70 of FIG. 7 and device 50 of FIG. 5. A trough 52 is provided between glide foils 61 extending essentially vertically. The trough is filled with treatment medium and the web 1 is led vertically into the trough from above. On both sides of the web 1, the glide foils 61 rest against the opposing sides of bars 62 that face each other and extend in the direction transverse to the web 1. The bars 62 have mutually opposing channels 63 in which resilient pressing elements 100 are arranged that are formed as thick-walled tubing 64. The tubing 64 extends over the width of the web 1 and has, because of the rigidity of its sides, resistance to being compressed. In addition, in the illustrated embodiment tubes 64 are adjustably filled with air under pressure such that pressure remains uniform over the length of the tubing 64 due to the interaction of the air pressure and the additional pressure generated by local compression and deformation of the tubing 64.

The bars 62 are guided by bolts 65 carried by stays 68 that extend parallel to the web 1. Stays 68 comprise part of supports 69 formed as carriers extending transversely over the width of the Web such that they can shift perpendicular to the web 1 relative to each other. The stationary carriers 68 are arranged outside the bars 62, and between the stays 68 and the bars 62 pressure elements 67 are located that comprise pressure tubing. The pressure tubing is subdivided by crimped connections 71 into a center section 72 and two outer sections 73. Each section 72, 73 can be filled separately with a fluid medium. By setting the pressure in the individual sections 72, 73, the bar 62 is bent somewhat causing the tubing 64 to become compressed to varying degrees over its length and thereby transmit correspondingly varying forces to the glide foil 61 and the web 1.

Figure 11:
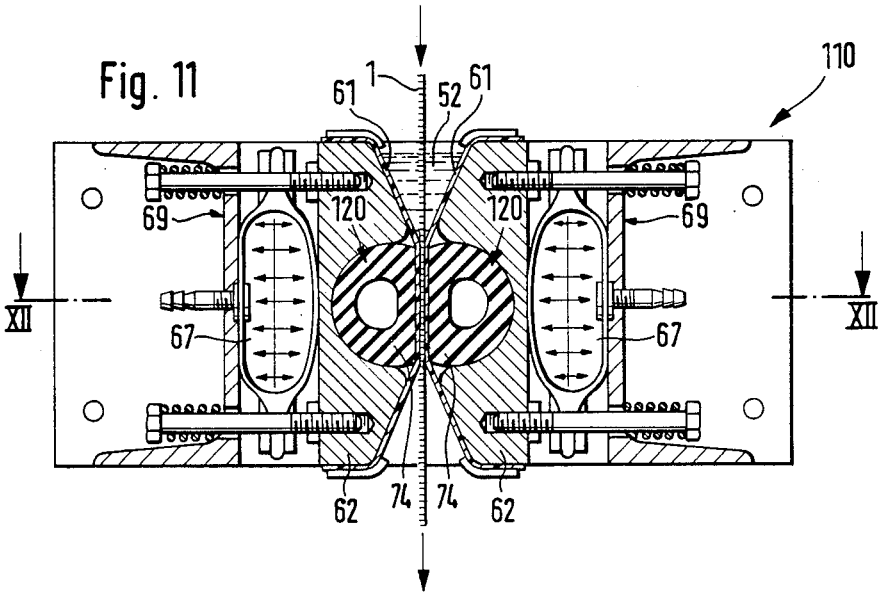
FIG. 11 shows a section corresponding to FIG. 1 along line XI—XI in FIG. 12 of a sixth embodiment.
Figure 12:
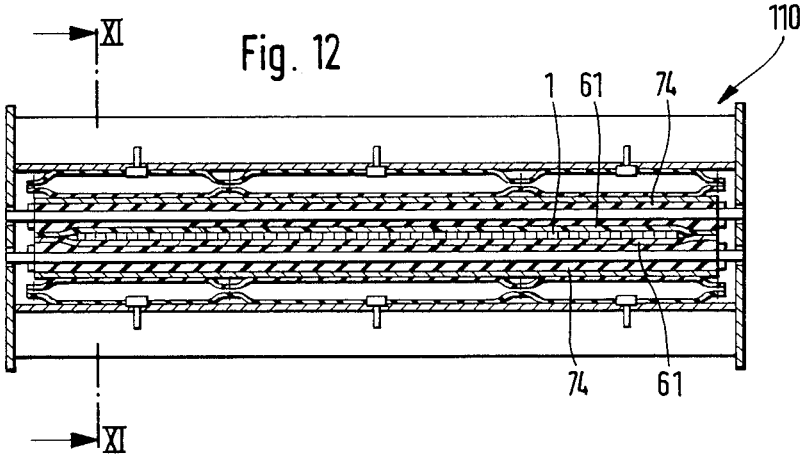
FIG. 12 shows a cross sectional view along line XII—XII in FIG. 11 in reduced scale.

Device 110 in FIGS. 11 and 12 differs from device 90 only in that the resilient pressing elements 120 are formed by a thick-walled tubing 74 of rubber, which may be open at its ends. Massive cylindrical sections of rubber may also be employed. These resilient pressing elements act only through their inherent resistance against being compressed and have no internal pressure that remains uniform over the width.

The device 130 in FIG. 13 illustrates that the pressure elements may also have a tubular shape or resemble balloons. The web 1 is pressed against the opposing face 75 by a resilient pressing element 140 and moves perpendicularly to the web. The pressing element 140 itself has a resistance against deformation, i.e., the pressure it exerts against the web 1 increases, the more it is compressed together.

In the left bottom half of FIG. 13 pressure elements 85 in the form of pneumatic cylinders or mechanical spindle devices are provided that are arranged on a fixed support 79 and act upon a plate 38, Which corresponds to plate 38 described in FIG. 5. The plate 38 experiences bending and increasingly deforms the resilient pressing element 140 in the direction of the web center. The pressure exerted on the web 1 behaves in a similar manner. The pressure elements 85 are independently actuatable.

The pressure elements 95 in the right bottom half of FIG. 13 act, by way of pressure plates 86, directly upon the resilient pressing element 140.

We claim:

1. Apparatus for applying a treatment medium onto a continuously advancing web comprising:

(a) an applicator device containing a gap to which treatment medium is conducted for application of treatment medium onto the web as it passes through the gap, said gap having first and second mutually opposing faces extending transverse to the web through which the web passes, said first and second mutually opposing faces being provided on opposite sides of the web and being stationary in the direction parallel to the web;

(b) a pressurizable oblong cushion extending across the width of the web supported in a stationary abutment, said cushion being subdivided into a plurality of cushion sections defining said second mutually opposing face, which is resilient in the direction perpendicular to the web; and (c) means for separately controlling the pressure in at least one of the cushion sections whereby the second mutually opposing face presses the web against the first mutually opposing face with non-uniform pressure that varies over the width of the web such that the amount of treatment medium applied to the web varies over the width of the web.

2. Apparatus according to claim 1 wherein the web comprises a center portion and two edge portions, each of said edge portions extends from an outer edge of the web toward the center portion for a distance of up to about one-third of the width of the web, and said cushion exerts a first pressure in the center portion and a second a pressure in the edge portions that is different from said first pressure.

3. Apparatus according to claim 2 wherein the second pressure is greater than the first pressure.

4. Apparatus according to claim 1 further comprising an oblong pressure member provided between said cushion and the web, said pressure member having a resistance against compression defined by its inherent rigidity that increases with the amount of deformation in a direction transverse to the web.

5. Apparatus according to claim 4 further comprising a relatively rigid, transversely deformable member disposed between the cushion and the oblong pressure member.

6. Apparatus according to claim 5 wherein said relatively rigid, transversely deformable member is formed with a channel facing the web in which said oblong pressure member is disposed.

* * * * *